US011015417B2

(12) United States Patent
Surjaatmadja

(10) Patent No.: US 11,015,417 B2
(45) Date of Patent: May 25, 2021

(54) USING CEMENT SLURRIES IN HYDRAJETTING TOOLS

(71) Applicant: Halliburton Energy Services, Inc., Houston, TX (US)

(72) Inventor: Jim Basuki Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 412 days.

(21) Appl. No.: 15/113,194

(22) PCT Filed: Apr. 7, 2014

(86) PCT No.: PCT/US2014/033135

§ 371 (c)(1),
(2) Date: Jul. 21, 2016

(87) PCT Pub. No.: WO2015/156755

PCT Pub. Date: Oct. 15, 2015

(65) Prior Publication Data

US 2017/0009554 A1 Jan. 12, 2017

(51) Int. Cl.

| | |
|---|---|
| ***E21B 33/138*** | (2006.01) |
| ***E21B 43/114*** | (2006.01) |
| ***E21B 33/13*** | (2006.01) |
| ***E21B 33/14*** | (2006.01) |

(52) U.S. Cl.
CPC ..... *E21B 33/138* (2013.01); *E21B 33/13* (2013.01); *E21B 33/14* (2013.01); *E21B 43/114* (2013.01)

(58) Field of Classification Search
CPC ..... E21B 33/138; E21B 33/13; E21B 33/14; E21B 43/114
See application file for complete search history.

(56) References Cited

U.S. PATENT DOCUMENTS

| | | | | |
|---|---|---|---|---|
| 3,130,786 | A * | 4/1964 | Brown | E21B 43/114 166/223 |
| 4,074,779 | A * | 2/1978 | Cheung | E21B 21/103 175/213 |
| 4,158,388 | A | 6/1979 | Owen et al. | |
| 4,475,591 | A * | 10/1984 | Cooke, Jr. | E21B 33/14 166/254.1 |
| 4,605,339 | A | 8/1986 | Bullivant | |
| 4,627,496 | A | 12/1986 | Ashford et al. | |
| 5,484,020 | A | 1/1996 | Cowan | |
| 5,765,642 | A | 6/1998 | Surjaatmadja | |

(Continued)

OTHER PUBLICATIONS

International Search Report and Written Opinion for PCT/US2014/033135 dated Jan. 8, 2015.

*Primary Examiner* — Waseem Moorad
*Assistant Examiner* — Neel Girish Patel
(74) *Attorney, Agent, or Firm* — Gilliam IP PLLC

(57) ABSTRACT

Methods including providing a hydrajetting tool comprising a housing having a top end and a bottom end and having a plurality of jetting nozzles disposed thereon, the top end of the housing fluidly coupled to a tool string; positioning the hydrajetting tool adjacent to a substantially solid target; perforating or cutting the substantially solid target using a cement slurry injected through at least one of the plurality of jetting nozzles, thereby forming at least one perforation or cut.

22 Claims, 5 Drawing Sheets

(56) References Cited

U.S. PATENT DOCUMENTS

| | | | | |
|---|---|---|---|---|
| 6,183,166 | B1 * | 2/2001 | Schellhorn | E02D 5/38 405/233 |
| 6,662,874 | B2 | 12/2003 | Surjaatmadja et al. | |
| 6,719,054 | B2 | 4/2004 | Cheng et al. | |
| 6,739,806 | B1 | 5/2004 | Szymanski et al. | |
| 6,779,607 | B2 | 8/2004 | Middaugh et al. | |
| 7,617,871 | B2 | 11/2009 | Surjaatmadja et al. | |
| 2001/0050172 | A1 * | 12/2001 | Tolman | E21B 17/203 166/297 |
| 2003/0056953 | A1 * | 3/2003 | Tumlin | E21B 33/134 166/298 |
| 2005/0230107 | A1 | 10/2005 | McDaniel et al. | |
| 2010/0212903 | A1 * | 8/2010 | Dotson | E21B 43/114 166/298 |
| 2011/0247815 | A1 * | 10/2011 | Jelsma | E21B 29/06 166/298 |
| 2012/0043093 | A1 * | 2/2012 | Cravatte | E21B 21/103 166/376 |
| 2012/0305679 | A1 * | 12/2012 | Surjaatmadja | E21B 41/0078 239/589 |
| 2012/0312536 | A1 * | 12/2012 | Mccallum | E21B 43/26 166/298 |
| 2014/0027115 | A1 * | 1/2014 | Sanders | E21B 43/08 166/278 |
| 2015/0166873 | A1 * | 6/2015 | Tomlinson | C09K 8/487 166/293 |
| 2017/0234127 | A1 * | 8/2017 | Bartetzko | E21B 49/00 166/250.05 |

* cited by examiner

USING CEMENT SLURRIES IN HYDRAJETTING TOOLS

BACKGROUND

The present disclosure relates to systems and methods for using cement slurries in hydrajetting tools. Specifically, the present disclosure relates to systems and methods for using cement slurries in hydrajetting tools for subterranean formation operations, including remedial and plug & abandonment cementing operations.

Hydrocarbon producing wells are often formed by drilling a wellbore in a subterranean formation. A casing string may be placed within the wellbore, an annulus being formed between the casing string and the wellbore. The casing string may be cemented into place by pumping a cement composition through the casing string and up and out into the annulus. The cement composition then cures in the annulus, thereby forming a sheath of hardened cement (or "cement sheath") that, inter alia, supports and positions the casing string in the wellbore and bonds the exterior surface of the casing to the subterranean formation. This process is referred to as "primary cementing." Among other things, the cement sheath may keep freshwater zones from becoming contaminated with produced fluids from within the wellbore. As used herein, the term "fluid" refers to liquid phase fluids and gas phase fluids. The cement sheath may also prevent unstable formations from caving in, thereby reducing the chance of a casing collapse and/or stuck drill pipe. Finally, the cement sheath forms a solid barrier to prevent fluid loss or contamination of production zones.

At the outset during hydration, or curing, of the cement composition, or over time, small channels or leak paths may be formed within the cement sheath. As used herein, the term "channel" or "leak path" refers to a defect in the quality of the cured cement composition of a cement sheath, where the cement does not fully occupy the annulus between the casing string and the wellbore. Such channels may be formed within the cement sheath itself or may be formed due to de-bonding between the cement and the face of the wellbore or between the cement and the casing string. These channels may compromise the integrity of the cement sheath. For example, fluid may migrate into these cavities, resulting in failure of zonal isolation, which may cause environmental contamination. The pressure created by the fluid migration may also lead to a well blowout. Moreover, the loss of integrity of the cement sheath may cause casing collapse. Because of the potentially costly effects of channel formation within a formed cement sheath, both in terms of environmental and economic terms, remedial methods may be employed to correct or reduce the loss of integrity to the cement sheath, such as, introducing cement into the channels in the cement sheath through a perforation in the casing string.

In some instances, remedial operations may be insufficient, or for other reasons such as a hydrocarbon well reaching the end of its useful life, the well may be decommissioned for abandonment. In such instances, various state and federal "plug and abandonment" procedures are required before the well can be effectively decommissioned. Plug and abandonment operations performed in a cased wellbore require that certain portions of the wellbore be filled with cement to prevent the upward movement of fluids towards the surface of the well. To seal the wellbore, a sealing device is typically placed at a predetermined depth within the wellbore and cement is then introduced to form a column of cement high enough to ensure that the wellbore is permanently plugged.

Abandoned wells, over time, may fail in preventing the upward movement of fluids towards the surface of the well, resulting in leaking. The leak(s) may result from corroded casing strings, a loose sealing device, an improperly placed cement plug, and the like. Such leaking may result in environmental concerns, such as contaminated drinking water or, in the case of offshore wells, contaminated water may negatively impact the surrounding ecosystem. Accordingly, control of such leakage is desirable to avoid potential costly environmental and economic concerns.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
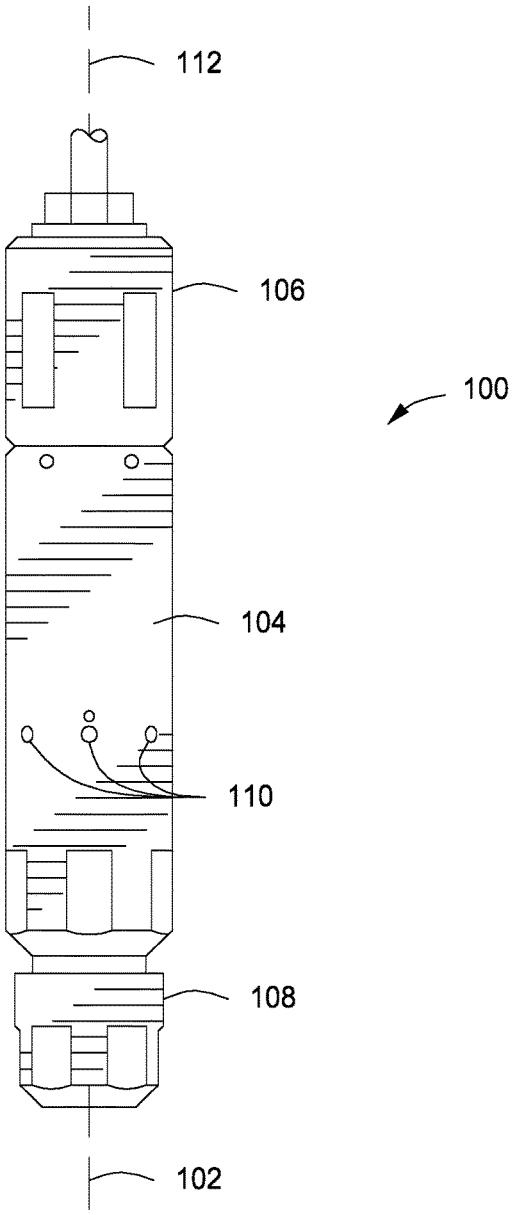
FIG. 1 depicts a hydrajetting tool according to one or more embodiments of the present disclosure.

The present disclosure relates to systems and methods for using cement slurries in hydrajetting tools. Specifically, the present disclosure relates to systems and methods for using cement slurries in hydrajetting tools for subterranean formation operations, including remedial and plug & abandonment cementing operations.

The use of hydrajetting tools in performing the remedial and plug & abandonment cementing operations described herein allow for reduced time in performing such operations because, in most cases, the hydrajetting tool alone is capable of performing the entire operation, without the need to remove the hydrajetting tool from the formation and replace it with other downhole tools or to change the fluid being expelled from the hydrajetting tool. For example, in traditional operations, methods designed to displace metal, cured cement, or formation barriers typically expel an abrasive jetting fluid (e.g., sand laden fluids) and upon later placement of cement, the abrasive jetting fluid must be replaced with a cement slurry. The embodiments described herein permit the hydrajetting tool to be configured to expel a cement slurry at an adjustable rate and pressure sufficient to displace metal, cured cement, or formation barriers (e.g., perforating a casing string), and the like, and place a cement slurry for later curing at a desired location. The hydrajetting may be particularly effective due to the Bernoulli effect. The Bernoulli effect defines the principle that an increase in the speed of a fluid occurs simultaneously with a decrease in pressure or a decrease in the fluid's potential energy. The Bernoulli effect states that the total energy containing by a fluid body remains the same and it may be particularly beneficial when the cement slurry is ejected through the hydrajetting tool and impacts a surface at a high pressure, where it erodes away the casing at the point of impact, thereby effectively perforating the casing. Furthermore, use of the hydrajetting tool may result in a wider and deeper area to place the cement slurry after perforation. The embodiments herein may permit a reduction in time spent on a particular operation, as well as enhanced cement attachment to a desired substrate (e.g., the formation) because cement itself is used to abrade or otherwise cut the substrate.

The hydrajetting tool is delivered downhole to a position of interest by using a tool string, such as a pipe or coiled tubing ("CT") units, for example. The tool string may additionally be configured to deliver and/or retrieve certain downhole components (e.g., sealing devices), thereby further reducing the time spent on a particular operation, the equipment footprint required in performing the operation, and the operator hours required to complete it, for example.

One or more illustrative embodiments disclosed herein are presented below. It is understood that figures provided herein to illustrate such embodiments are not necessarily drawn to scale and should not be interpreted as such. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

Use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead. These definitions are valid for both horizontal and deviated wells.

Referring now to FIG. 1, illustrated is an exemplary hydrajetting tool 100, according to one or more embodiments of the present disclosure. As illustrated, hydrajetting tool 100 may at least include, arranged along the longitudinal axis 102 of the hydrajetting tool 100, a housing 104. The housing 104 may have a top end 106 and a bottom end 108. The housing 104 of the hydrajetting tool 100 may have a plurality of jetting nozzles 110 arranged thereon. The jetting nozzles 110 may be configured such that one or more of the jetting nozzles 110 may eject or otherwise dispel a cement slurry or any other such fluid at an adjustable rate and pressure. In some embodiments, certain jetting nozzles 110 may be configured to eject the cement slurry or fluid at one rate and pressure while other jetting nozzles 110 may be configured to eject the cement slurry or fluid at a different rate and pressure. The jetting nozzles 110 may be configured to eject the cement slurry at a rate and pressure sufficient to perforate a substantially solid target, such as relatively hard material including, metal (e.g., steel, a steel alloy, a metal alloy, and the like), cured cement, formation rock, combinations thereof, and the like. As used herein, the term "substantially solid" refers to a substance that is largely, but may not be wholly, firm and stable in shape without spaces or gaps therethrough. As used herein, the term "perforate," and grammatical variations thereof (e.g., "perforation," "perforating," and the like), refers to piercing and making a hole in a substantially solid substance. The term "perforate" does not limit the size or shape of the hole made (e.g., the hole may be large or small and circular-shaped, square-shaped, rectangular-shaped, polygonal-shaped, and the like). As used herein, the term "cut," and grammatical variations thereof (e.g., "cutting," and the like), refers to piercing and making an elongated incision in a substantially solid substance. The term "cut" does not limit the length of the elongated incision or the width or shape of it (e.g., the cut may be generally linear, curvy, zigzagged, and of any length or width). The term "cut" also does not imply removal of a portion of the substantially solid substance being cut from any other portion of the substantially solid substance, although, in some embodiments herein, cutting results in such removal.

In some embodiments, the cement slurry may be dispelled from the hydrajetting tool 100 at a rate of between a lower limit of about 50 ft/sec, 100 ft/sec, 150 ft/sec, 200 ft/sec, 250 ft/sec, 300 ft/sec, 350 ft/sec, 400 ft/sec, 450 ft/sec, and 500 ft/sec to an upper limit of about 1000 ft/sec, 950 ft/sec, 900 ft/sec, 850 ft/sec, 800 ft/sec, 750 ft/sec, 700 ft/sec, 650 ft/sec, 600 ft/sec, 550 ft/sec, and 500 ft/sec, and encompassing any value therebetween. In some preferred embodiments, the cement slurry may be dispelled from the hydrajetting tool 100 at a rate of between about 400 ft/sec to about 700 ft/sec and encompassing any value therebetween.

The jetting nozzles 110 may be configured to have a screen disposed in-line with the jetting nozzles 110 that filter out any cement particulates in the cement slurry larger than the jetting nozzle 110 itself. Such configuration prevents or reduces the likelihood of clogging the jetting nozzles 110 with components of the cement slurry. The embodiments herein may comprise a hydrajetting tool 100 having jetting nozzles 110 of varying sizes, such that the screen sizes (mesh sizes) may vary depending on the size of the particular jetting nozzle 110 with which it is in-line. In some embodiments, it is contemplated that such screens or filter devices may be located at the surface for ease of cleaning and other maintenance activities. Furthermore, the formation of so-called "fish-eye" globules, or conglomerates or droplets of particulates (e.g., partly hydrated polymer), may be common in cement slurries and the screen or filtering devices that may be used in combination with the hydrajetting tool 100 described herein may be equipped with rotary scrapers that push the fish-eyes through the screens or filtering devices.

In some embodiments, the hydrajetting tool 100 may be rotatable about the longitudinal access 102, thereby capable of injecting a generally continuous stream of the cement slurry over greater areas (i.e., the jetting nozzles inject the cement slurry as the hydrajetting tool 100 is rotating), which may encompass using the continuous stream of cement slurry to perform cutting or displacement operations (e.g., removal of a section of casing string). Such rotation may be achieved by including one or more swivel components (not shown) either above the top end 106 of the hydrajetting tool 100 or below the bottom end 108 of the hydrajetting tool 100, or both. In some embodiments, the housing 104 of the hydrajetting tool 100 is fluidly coupled to a tool string 112 that can be used to place the hydrajetting tool into a cavity, as discussed below, for stabilizing unstable soil or rock formations. For applications using jointed tool string, the swivel may also be at the surface, above a rotary table that may operate to rotate the pipe and bottomhole assembly ("BHA"). The tool string 112 is a tubular capable of conveying at least the cement slurry described herein to the hydrajetting tool 100.

In some embodiments, as illustrated, the housing 104 may be cylindrical in shape and may be the plurality of jetting nozzles 110 disposed about the circumference of the housing. The jetting nozzles 110 may be spaced apart equidistantly on the housing along the circumference of the housing 104 of the hydrajetting tool 100 or spaced apart in a planned pattern or randomly, without departing from the scope of the present disclosure. Although three jetting nozzles 110 are shown on the housing 104 of the hydrajetting tool 100, it will be appreciated by one of ordinary skill in the art that any number of jetting nozzles 110 may be located on the housing 104 at any location of the hydrajetting tool 100, without departing from the scope of the present disclosure. Moreover, although the housing 104 is depicted as a cylinder, it may be any shape suitable for use in a grouting stabilization operation. For example, in some embodiments, where the hydrajetting tool 100 itself is used to form cavities for completing grouting stabilization operations, as discussed below in detail, a tapered housing 104 may be preferred where the diameter of the bottom end 108 is less than the diameter of the top end 106. Such a configuration may aid in placing the hydrajetting tool 100 adjacent to or into unstable soil or unstable rock formation.

In addition to the illustrated embodiment, the hydrajetting tool 100 of the present disclosure may further comprise additional components operatively coupled thereto, such as a stabilizer capable of keeping the hydrajetting tool 100 from rotating, one or more additional housings 104 arranged along the longitudinal axis 102 above or below the illustrated hydrajetting tool 100 to increase the hydrajetting area that a particular hydrajetting tool may achieve. Moreover, the structural arrangement of the hydrajetting tool 100 itself may vary, without departing from the scope of the present disclosure (e.g., the hydrajetting tool 100 may be along a horizontal axis, rather than a longitudinal axis), and any additional components may be structurally arranged in any combination with the components of the illustrated hydrajetting tool 100, provided that it is capable of injecting a cement slurry to stabilize unstable soil or rock formation.

In some exemplary embodiments, as will be discussed in further detail below, the hydrajetting tool 100 may further comprise a detachable one or more sealing devices located above the top end 106 of the housing 104 or below the bottom end 108 of the housing 104, or both. In some embodiments, the detachable sealing device(s) may be positioned on the tool string 112. In such cases, where a detachable sealing device is located below the bottom end 108 of the housing 104, the tool string 112 may extend below the bottom end 108 of the housing 104. In other embodiments, the detachable sealing device may be mechanically attached to the hydrajetting tool 100, such as with a j-hook or other latching mechanism capable of de-latching to place the detachable sealing device at a desired location. In some embodiments, the detachable sealing device may be removable, for example, drillable sealing devices, self-destructive sealing devices, inflatable/de-inflatable sealing devices, and the like. In other embodiments, the detachable sealing device may be configured for permanent placement within a subterranean formation (e.g., for plug and abandonment operations, and the like). In some embodiments, the present disclosure provides a method including providing a hydrajetting tool 100 comprising a housing 104 having a top end 106 and a bottom end 108 and having a plurality of jetting nozzles 110 disposed thereon, the top end 106 of the housing 104 fluidly coupled to a tool string 112; introducing the hydrajetting tool 100 into a subterranean formation, wherein a well casing is disposed in the subterranean formation forming an annulus between the well casing and the subterranean formation, the annulus having cured cement disposed therein; and perforating the well casing using a cement slurry through at least one of the plurality of jetting nozzles at a first treatment interval, thereby forming at least one perforation. In some embodiments the cured cement may comprise at least one leak path therein. The cement slurry may be injected through at least one of the plurality of jetting nozzles 110, through the at least one perforation, and into the leak path. The cement slurry may cure to plug the leak path. That is, the hydrajetting tool 100 may be used to perforate the well casing with the cement slurry alone or may thereafter be used to further introduce the cement slurry into a cured cement sheath having leak paths, so as to plug or fill the leak paths (i.e., a cement squeeze operation).

The hydrajetting tool 100 may have, as discussed above, a detachable sealing device located at either or both of the top end 106 of the housing 104 or the bottom end 108 of the housing 104. The detachable sealing device may be placed at a location at either or both below the first treatment interval or above the first treatment interval. For example, in some embodiments, two sealing devices may be placed such that the hydrajetting tool interposes an upper sealing device and a lower sealing device. The term "sealing device," as referred to herein, includes any device capable of sealing off a portion of a wellbore from another portion of the wellbore, including, for example, packers and bridge plugs. In some embodiments, the upper sealing device may be a packer and the lower sealing device may be a bridge plug. In other embodiments, the upper sealing device and the lower sealing device may be packers. In those embodiments where the lower sealing device is a packer and the cement slurry is introduced through the jetting nozzles 110 of the hydrajetting tool 100 under pressure, a plug may preferably be placed beneath or otherwise inside the packer to prevent the cement slurry from seeping into unwanted areas downhole.

The sealing devices may serve to isolate the first treatment interval, for example, or to isolate the area that receives the cement slurry. The sealing devices may thereafter be removed (e.g., drilled out) after the cement slurry has cured or may be left in place. In other embodiments, a sealing device may be placed below the first treatment interval and the cement slurry may be ejected through the jetting nozzles 110 and flow atop the sealing device and cured into a cement plug, thereby increasing the size or area and quality plugging, such as for a plug and abandonment operation.

Figure 2:
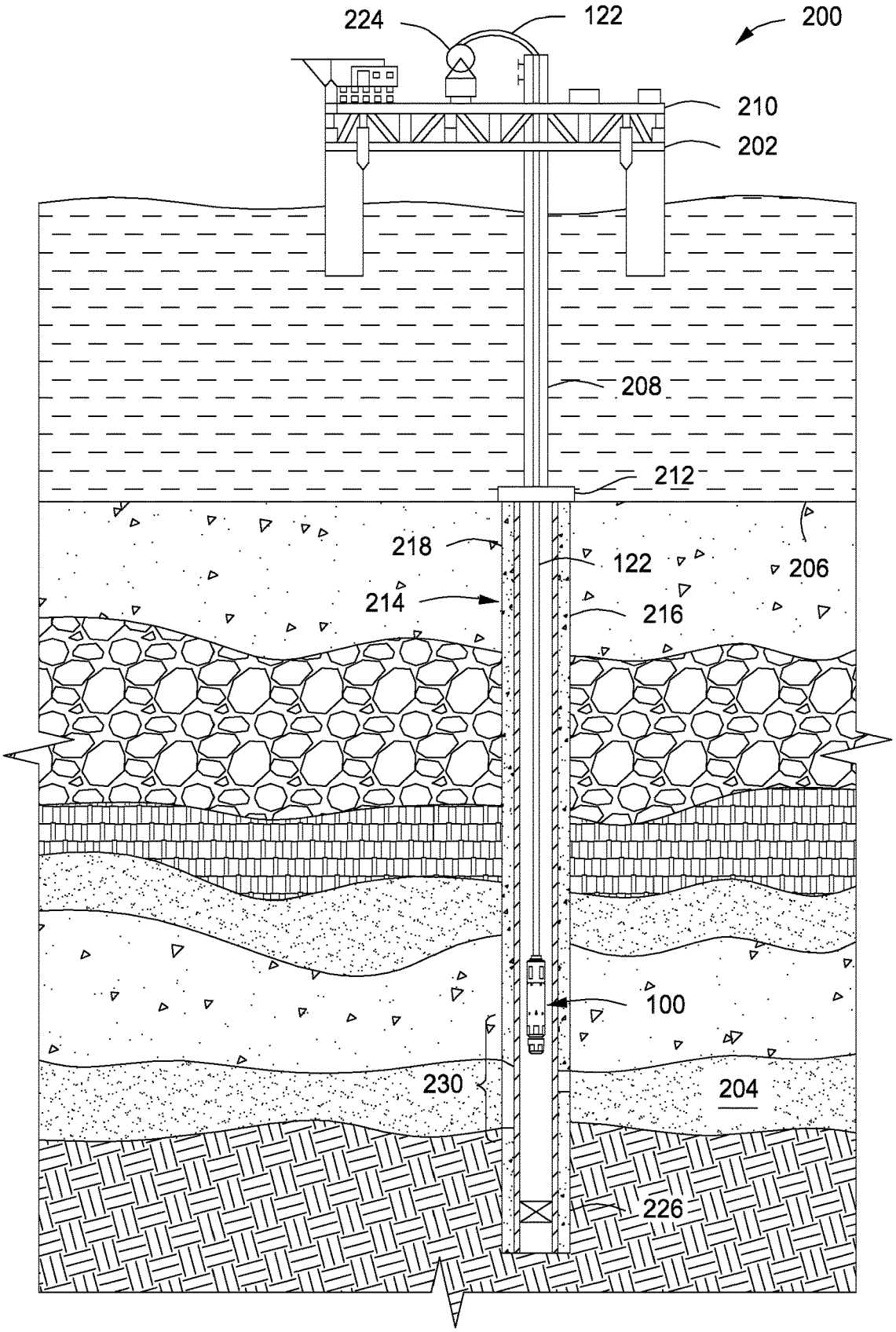
FIG. 2 is an offshore oil and gas rig that may employ one or more principles of the present disclosure, according to one or more embodiments.

Referring to FIG. 2, with continued reference to FIG. 1, illustrated is an offshore oil and gas rig 100 that may employ one or more principles of the present disclosure, according to one or more embodiments. Even though FIG. 2 generally depicts an offshore oil and gas rig 200, those skilled in the art will readily recognize that the various embodiments disclosed and discussed herein are equally well suited for use in or on other types of service rigs, such as land-based rigs or rigs located at any other geographical site. Moreover, the various embodiments disclosed and discussed herein are equally well suited for use in oil and gas wells, as well as intersecting wells drilled parallel to oil and gas wells, as will be discussed in greater detail below.

As illustrated, the rig 200 may encompass a semi-submersible platform 202 centered over one more submerged subterranean formation 204 located below the sea floor 206. A subsea conduit 208 or riser extends from the deck 210 of the platform 202 to a wellhead installation 212 arranged at or near the sea floor 206. As depicted, a wellbore 214 extends from the sea floor 206 and has been drilled through various earth strata, including various submerged subterranean formations 204, which may have exceeded their useful life (e.g., in a plug and abandonment operation). A casing string 216 is at least partially cemented within the wellbore 214 with cement 218. The casing may be of the type known to those skilled in the art as a "liner" and may be segmented (e.g., having casing collars that connect the segments in the wellbore 214). As used herein, the term "casing collar" or "collar" refers to a treaded connector used to connect two joints or segments of casing string.

If the wellbore is a hydrocarbon producing well itself, during the viable life of the well, hydrocarbons may be extracted from the formation 204 and produced to the rig 200 or other facilities via the wellbore 214 and the subsea conduit 208 or other subsea conduits for processing. During the life of the well, a remedial squeeze operation may be required to correct leak paths in the cement 218 between the wellbore 214 and the casing string 216, as discussed above. Additionally, once the available hydrocarbons in the formation 204 are depleted or it is otherwise economically impracticable to maintain the well, a well operator may decide to decommission the well using a plug and abandonment operation.

According to the embodiments herein, the wellbore 214 may be prepared for a cement squeeze operation and/or a plugging and abandonment operation using a hydrajetting tool 100 that is introduced into the wellbore 214 from the rig 200. The hydrajetting tool 100 may be run into the wellbore 214 on a tool string 112, which may be fed into the wellbore 214 from a reel 224 arranged on the deck 210 of platform 202. In some embodiments, the tool string 112 may be a flexible conduit, such as coiled tubing or the like. In other embodiments, the tool string 112 may be any rigid or semi-rigid conduit capable of conveying the hydrajetting tool 100 into the wellbore 214. The tool string 112 may also include other tools suitable for use in a subterranean formation operation including, for example, centralizers, actuators, gage carriers, or other tools commonly used in intervention operations. In at least one embodiment, the tool string 112 may be drill pipe or another type of rigid tubular and, in such embodiments, the reel 224 may be replaced by other means, such as by a workover (or servicing) rig that may be purely mechanical or hydraulic.

As part of the preparation process for a cement squeeze operation or a plugging and abandonment operation, a sealing device (e.g., a bridge plug) 226 may be set within the wellbore 214 below the hydrajetting tool 100 to seal the lower portion of the wellbore 214. In some cases, the sealing device 226 may be pre-placed in the wellbore 214 prior to running the hydrajetting tool 100 into the wellbore 214. In other embodiments, as discussed previously, the hydrajetting tool 100 may be part of a set of tools, which may be used to help facilitate the placement and setting of the sealing device 226, such as by delivering the sealing device 226 to the desired location, positioning the sealing device 226 in the wellbore 214, and detaching from the sealing device 226. The area above the sealing device 226 may be referred to as a treatment interval 230, the desired target area for performing a cement squeeze or a plug and abandonment operation, as described herein, for example. It will be appreciated by one of ordinary skill in the art, that a second sealing device (e.g., a packer) may be positioned above the treatment interval 230 and the hydrajetting tool 100 may also facilitate placement and setting of the second sealing device, without departing from the scope of the present disclosure.

In various embodiments, the portion of the tool string 112 that is not connected to the hydrajetting tool 100 may be fluidly coupled to a pump (not shown). The tool string 112 may be used to lower the hydrajetting tool 100 into the formation 204, as depicted in FIG. 2. The tool string 112 may be configured to convey or otherwise deliver the cement slurries or abrasive jetting fluids, both of which are discussed in detail below, of the present disclosure to the hydrajetting tool 100 for ejection through the jetting nozzles 110. The pump may be, for example, a high pressure pump or a low pressure pump, which may depend on, inter alia, the viscosity and density of the cement slurry, the type of formation 204, the type of operation, and the like.

In some embodiments, one or more mixing tanks (not shown) may be arranged upstream of the pump and in which the cement slurry or abrasive jetting fluid may be formulated. In various embodiments, the pump (e.g., a low pressure pump, a high pressure pump, or a combination thereof) may convey the cement slurry or abrasive jetting fluid from the mixing tank or other source to the tool string 112. In other embodiments, however, the cement slurry or abrasive jetting fluid may be formulated offsite and transported to a worksite, in which case the cement slurry or abrasive jetting fluid may be introduced to the tool string 112 via the pump directly from a transport vehicle or a shipping container (e.g., a truck, a railcar, a barge, or the like) or from a transport pipeline. In yet other embodiments, the cement slurry or abrasive jetting fluid may be formulated on the fly at the worksite where components of the cement slurry or abrasive jetting fluid are pumped from a transport (e.g., a vehicle or pipeline) and mixed during introduction into the tool string 112. In any case, the cement slurry or abrasive jetting fluid may be drawn into the pump, elevated to an appropriate pressure and then introduced into the tool string 112 for delivery to the hydrajetting tool 100.

Figure 3C:
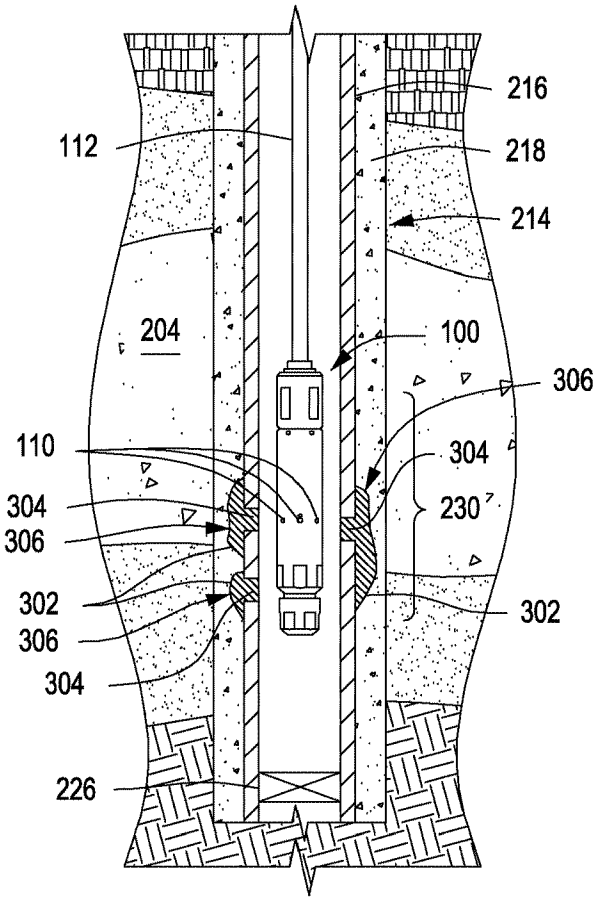
FIGS. 3A-C depict a cement squeeze operation using a hydrajetting tool according to one or more embodiments of the present disclosure.
Figure 3B:
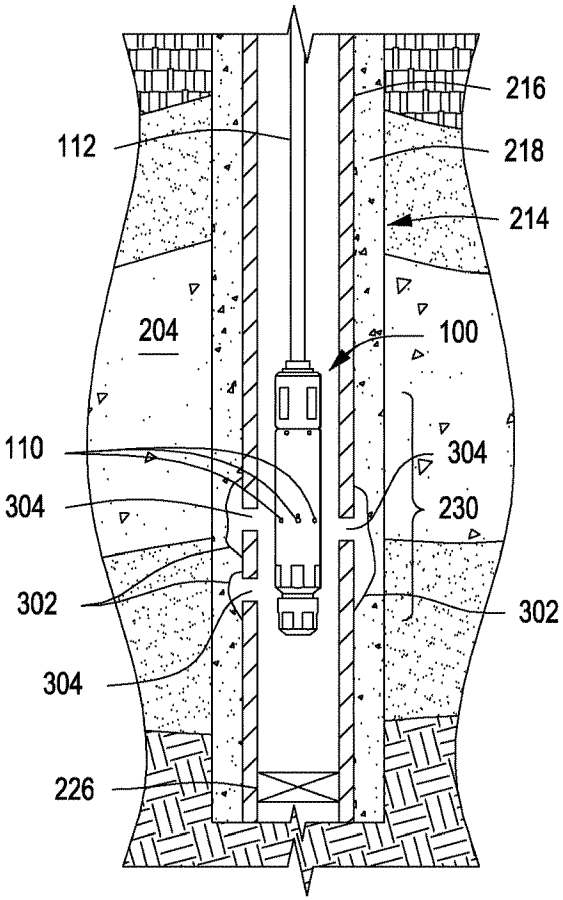
Figure 3A:
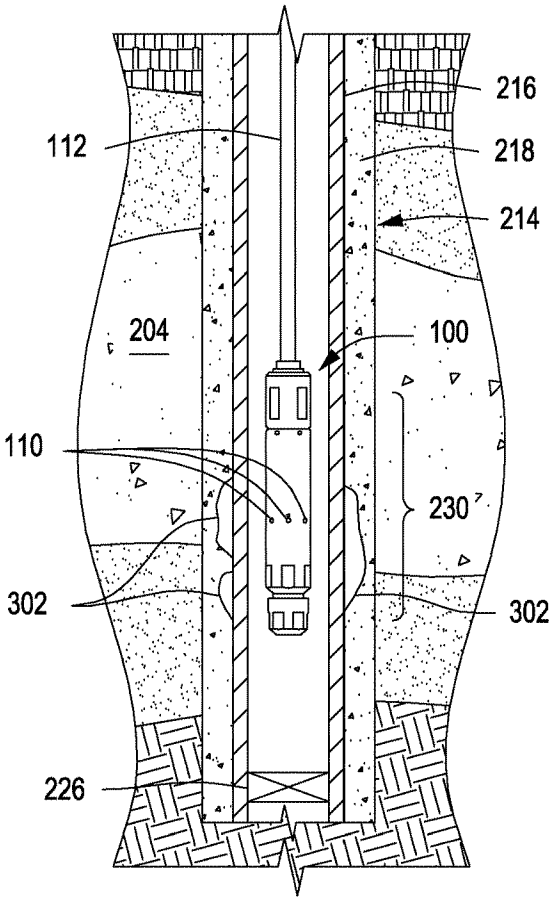

Referring now to FIGS. 3A-C, with continued reference to FIGS. 1 and 2, the hydrajetting tool 100 may be used in a cement squeeze operation. With respect to FIG. 3A, a wellbore 214 may be drilled through formation 204. Casing string 216 may be cemented in place in the wellbore 214 using cement 218. The cement 218 over time, for example, may develop one or more leak paths 302 in a treatment interval 230. As illustrated, the leak paths 302 may be formed from de-bonding between the cement 218 and the casing string 206, leaving a channel therebetween. It will be appreciated by one of ordinary skill in the art, however, that leak paths 302 may additionally be formed from channels or spaces anywhere throughout the cement 218. As illustrated, a sealing device 226 may be positioned below the treatment interval 230 to isolate the treatment interval 230 from the portion of the wellbore 214 below, for example. A second sealing device (e.g., a packer) may additionally be delivered and positioned at a location above the treatment interval 230, without departing from the scope of the present disclosure. As mentioned previously, the hydrajetting tool 100 may be configured to deliver and position the sealing device 226 into place. The hydrajetting tool 100 may deliver and position the sealing device 226 and be positioned at the treatment interval 230 using a tool string 112 lowered into the wellbore 214.

Once in position, and as illustrated in FIG. 3B, the hydrajetting tool 100 may be used to make one or more perforations 304 in the casing string 216, thereby exposing the cement 218 thereunder having leak paths 302. A cement slurry, described in greater detail below, may be ejected from one or more jetting nozzles 110 at a rate and pressure sufficient to form the perforations 304. In some embodiments, the perforations 304 may be formed by at least partially rotating the hydrajetting tool 100 having the jetting nozzles 110 disposed thereon. Although three perforations 304 are illustrated in FIG. 3B, it will be appreciated by one of ordinary skill in the art that any number of perforations 304 may be made in the casing string 216 at the treatment interval 230 sufficient to permit the cement slurry 306 to permeate the leak paths 302 in the cement 218 and cure into a hardened mass, thereby sealing or plugging the leak paths 302, as illustrated in FIG. 3C. Furthermore, the perforations 304 may be any size and shape necessary for adequately performing the cement squeeze operation (e.g., square, rectangular, circular, and the like). The cement slurry 306 may also seal the perforations 304 formed in the casing string 216, as illustrated. The hydrajetting tool 100 may thereafter be removed from the wellbore 214 and, optionally, the sealing device 226 may be removed (and any additional secondary sealing device) by any method known to those of ordinary skill in the art, for example, by drilling out the sealing device 226. The cement squeeze operation described herein may be repeated at one or more additional treatment intervals within the wellbore 214.

Figure 4C:
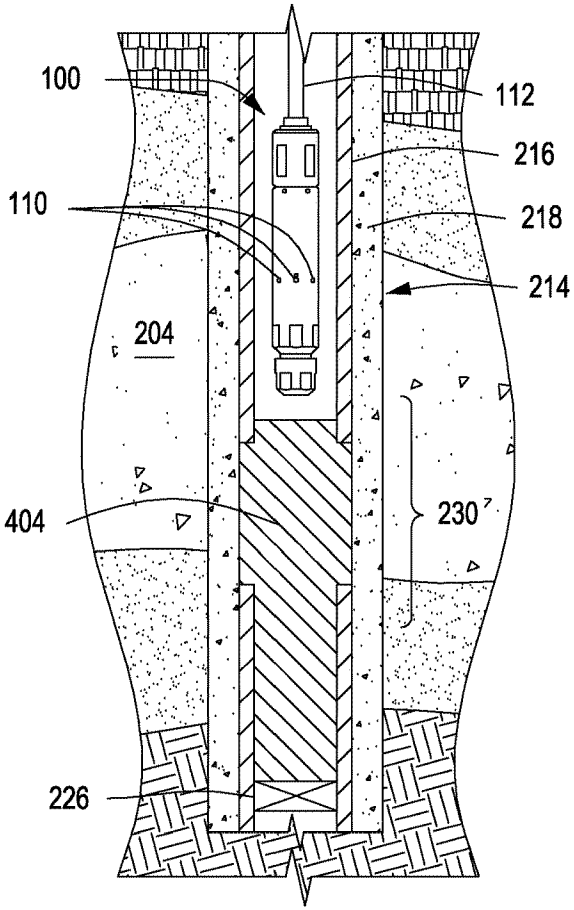
FIGS. 4A-C illustrate a plug and abandonment operation using a hydrajetting tool according to one or more embodiments of the present disclosure.
Figure 4B:
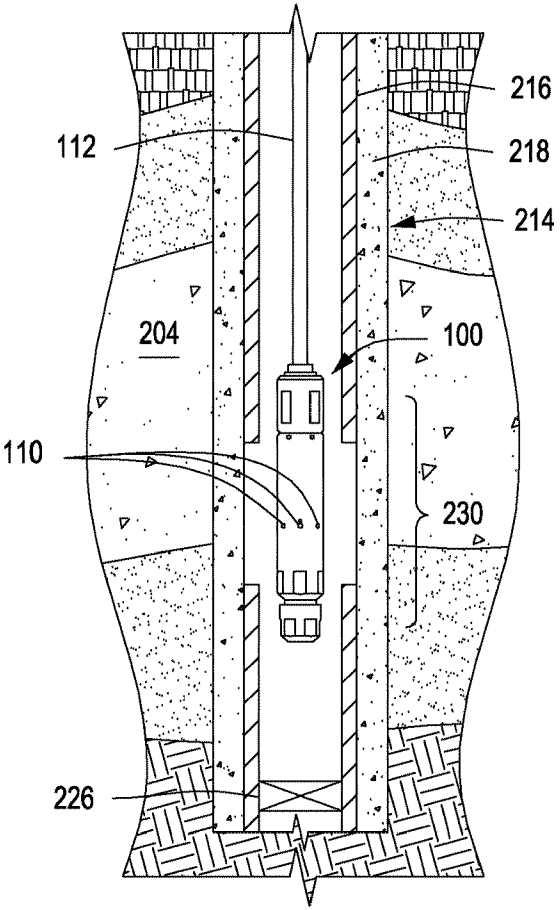
Figure 4A:
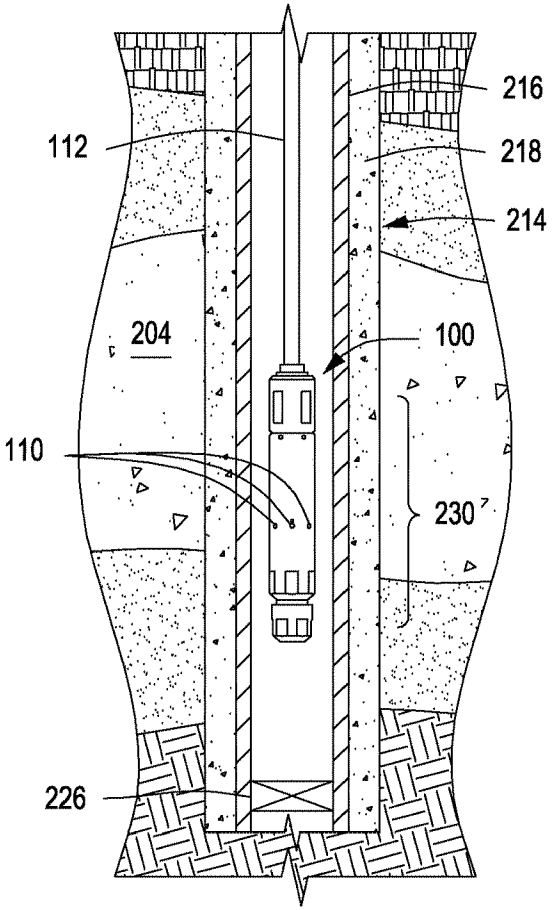

Referring now to FIG. 4A-C, the hydrajetting tool 100 may be used in a plug and abandonment operation to remove a circumferential portion of the casing string 216. With reference to FIG. 4A, a wellbore 214 may be drilled through formation 204. Casing string 216 may be cemented in place in the wellbore 214 using cement 218. As illustrated, a sealing device 226 may be positioned below the treatment interval 230 to isolate the treatment interval 230 from the portion of the wellbore 214 below, for example. However, a second sealing device (e.g., a packer) may also be delivered and positioned above the treatment interval 230, without departing from the scope of the present disclosure. As mentioned previously, the hydrajetting tool 100 may be configured to deliver and position the sealing device 226 into place. The treatment interval 230 may be an area in the wellbore 214 identified as requiring plugging to ensure that unwanted formation fluids from the formation 204 are prevented from escaping into the surrounding environment. The hydrajetting tool 100 may deliver and position the sealing device 226 and be positioned at the treatment interval 230 using a tool string 112 lowered into the wellbore 214.

As illustrated in FIG. 4B, a cement slurry (not shown) may be used as an abrasive fluid to remove a circumferential portion of the casing string 216 at the treatment interval 230. The cement slurry may be ejected from the jetting nozzles 110 on the hydrajetting tool 100 at a rate and pressure (which may take into account duration) sufficient to cut through the casing string 216 without substantially cutting into the cement 218. Cutting may be performed by any means necessary including, for example, stroking the hydrajetting tool 100 on the tool string 112 up and down an axis of the wellbore 214 (longitudinal axis, as illustrated, but may also be horizontal in the case of deviated wells, for example). In other embodiments, the hydrajetting tool 100 may be rotated as it is lowered or raised in the wellbore 214 in order to remove the casing string 216. The length of the treatment interval 230 may dictate the length of the circumferential portion of the casing string 216 that must be removed. In some cases, factors such as the size of a particular formation strata (e.g., a hydrocarbon bearing strata) may dictate the length of the treatment interval 230. In some situations, the debris from removing the circumferential portion of the casing string 216 may fall atop the sealing device 226, the sealing device 226 preventing the debris from falling further downhole. In some embodiments, the debris may be fished from the wellbore 214 or may be left to remain atop the sealing device 226 permanently.

Referring now to FIG. 4C, after the circumferential portion of the casing string 216 is removed from the treatment interval 230, the cement slurry may coat the cement 218 and flow atop the sealing device 226, thereby forming a cement plug 404 in the treatment interval 230 upon curing. The cement plug 404 may further encase the debris from the removal of the circumferential portion of the casing string 216 if it was not fished from the wellbore 214. In some embodiments, if a second sealing device was not used during formation of the cement plug, a second sealing device may be placed atop the cement plug 404.

In some embodiments (not shown), after the cement plug 404 is in place, the hydrajetting tool 100 may be positioned uphole of the cement plug 404 and used to cut the casing string 216 uphole of the cement plug 404 using a cement slurry ejected through the jetting nozzles 110 of the hydrajetting tool 100. The cement slurry may be ejected at a rate and pressure (which may take into account duration) to cut the casing string 216, such as, by rotating the hydrajetting tool 100 about the tool string 112. The cut casing string 216 may thereafter either be salvaged by pulling the cut casing string 216 from the wellbore 214 using, for example, a junk catcher (not shown) or left to remain inside the wellbore 214 above the sealing device 226. One of ordinary skill in the art will understand, with the benefit of this disclosure, that if the cut casing string 216 is to be salvaged, the cement slurry must be designed so as to not set or cure during the salvaging process (e.g., by using delayed curing additives or non-setting cement that has been chemically modified to prevent or delay curing). In some embodiments, the cement slurry may flow down atop the cement plug 404 as or after cutting the casing string 216 uphole of the cement plug 404. The cement may then cure and increase the size and/or integrity of the cement plug 404. In some embodiments, an abrasive fluid, as described below, rather than a cement slurry, may be used to cut the casing string 216 for salvaging.

In some embodiments, the plug and abandonment operation may comprise removing not only a circumferential portion of the casing string 216 at a treatment interval 230 with a hydrajetting tool 100, but also at least a portion of the cement 218 in the annulus between the casing string 216 and the wellbore 214 (not shown). In some embodiments, the cement 218 may be substantially removed (largely, but not necessarily wholly removed) using a cement slurry through the jetting nozzles 110 of the hydrajetting tool 100. Such removal may permit greater plugging capabilities, as the cement slurry bonds not simply to the cement 218 already positioned in the wellbore 214 and which may have undergone substantial stresses during the life of the wellbore 214, but to the formation 204 itself. In such embodiments, upon reaching the formation 204, the ejected cement slurry may further wash the formation 204 of debris that may have accumulated thereon, such debris capable of negatively impacting the adhesion of the cement slurry to the formation 204. Each of the various embodiments discussed herein in combination with the plug and abandonment operation removing only a circumferential portion of the casing string 216 may be used in combination with the plug and abandonment operation discussed herein involving further removing at least a portion of the cement 218 beneath the removed casing string 216. For example, but without limitation, such embodiments include delivering and positioning a second sealing device atop the cement plug, cutting and removing casing string above the cement plug, and the like. Moreover, both plug and abandonment operations may be performed at one or more additional treatment intervals, without departing from the scope of the present disclosure.

Figure 5B:
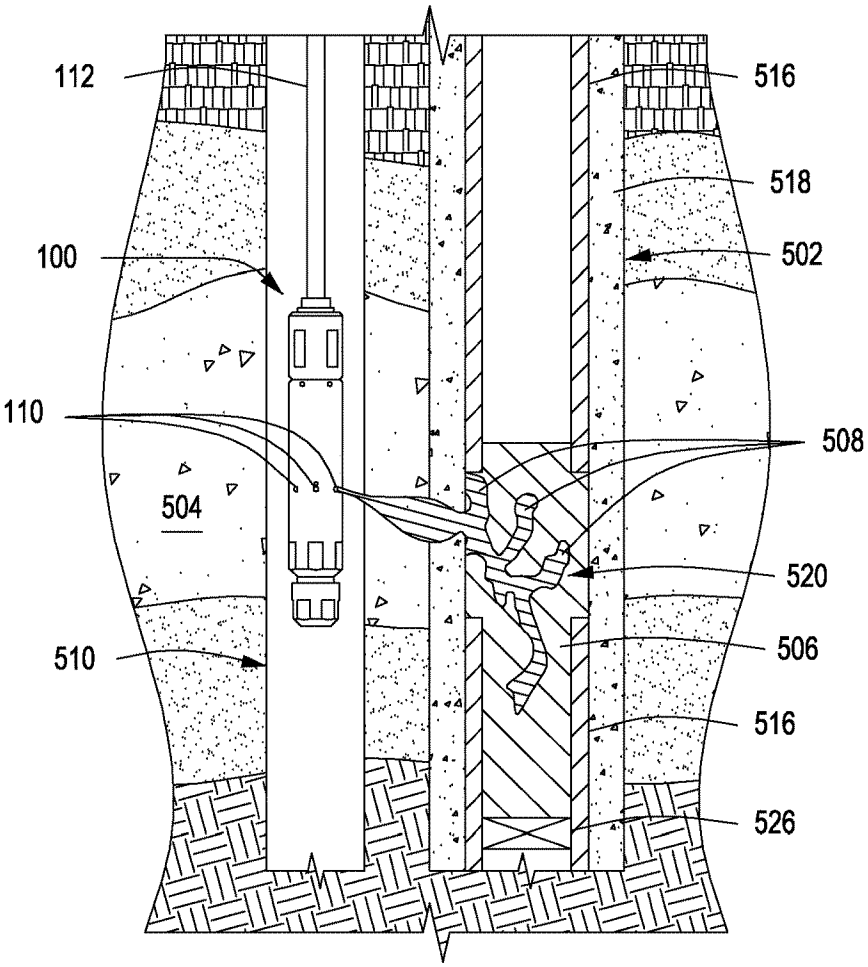
FIGS. 5A-B show a well intersecting operation using a hydrajetting tool according to one or more embodiments of the present disclosure.
Figure 5A:
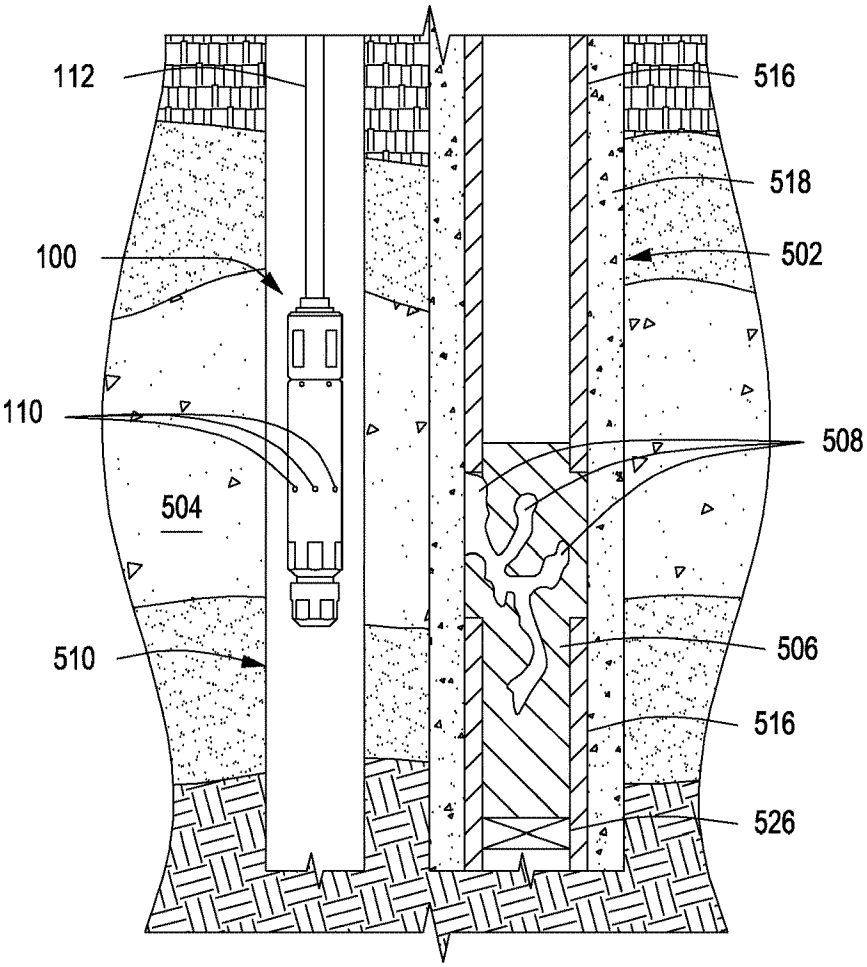

In some embodiments, the present disclosure provides a method of plugging leak paths in a cement plug in an already existing abandoned well (and "intersecting plug and abandonment operation" or simply "intersecting operation"). Such leak paths, like those that may form in a cement sheath, may cause zonal failure of the cement plug and may permit fluid invasion or otherwise escape of undesirable fluids from the formation into the surrounding environment. Referring now to FIG. 5A with continued reference to FIG. 1, depicted is an abandoned wellbore 502 positioned in a subterranean formation 504. The abandoned wellbore 502 has casing string 516 positioned therein, the casing string 516 cemented into place against the wellbore with cement 518. The abandoned wellbore 502 has a cement plug 506 that has been put in place atop a sealing device 526 to plug the abandoned wellbore 502 in accordance with one or more state and federal regulations, for example. The cement plug 506 may have one or more leak paths 508 disposed therein. The leak paths 508 may be interconnected or disperse channels or may be formed from the cement plug 506 detaching from the disposed cement 518 or even the formation 504 if the cement plug 506 is in contact with the formation 504 (not shown). In one or more embodiments, the disposed cement 518 may itself have leak paths therein (not shown).

An intersecting wellbore 510 may be drilled into the formation 504 substantially parallel to the abandoned wellbore 502. The intersecting wellbore 510 may be, in some embodiments, substantially parallel to the abandoned wellbore 502 at a distance of less than about 0.3 meters to about 1.2 meters (less than about 1 ft to about 4 ft). In other embodiments, the intersecting wellbore 510 may be closer or farther apart, depending on the nature of the particular operation, the formation composition between the two wellbores, and the like. Generally, the closer the intersecting wellbore 510 to the abandoned wellbore 502, the more successful the plugging operation to seal the leak paths 508 in the cement plug 506 therein. The intersecting wellbore 510 may be drilled substantially parallel to the abandoned wellbore 502 by using one or more methods to gauge the distance and whereabouts of the abandoned wellbore 502, such as by employing magnetic sensing equipment, for example.

A hydrajetting tool 100 according to one or more embodiments described herein may be introduced on a tool string 112 into the intersecting wellbore 502 and positioned adjacent to the cement plug 506 having leak paths. Referring now to FIG. 5B, a cement slurry 520 may be ejected through the jetting nozzles 110 disposed on the hydrajetting tool 100 and used to cut through the formation 504 disposed between the intersecting wellbore 510 and the abandoned wellbore 502. The cement slurry 520 may further be used to cut through the cement 518 disposed in the abandoned wellbore 502, if it was not previously removed during the plug and abandonment operation itself, as is described in some embodiments herein or by other methods. The cement slurry 520 may then permeate into one or more of the leak paths 508 in the cement plug 506 and cure to plug or seal the leak paths 508. The cement slurry 520 may beneficially also cure and plug the formation 504 area between the intersecting well 510 and the abandoned well 502 that was cut in order to permeate the cement slurry 520 into the leak paths 508, thereby further decreasing the chance of leakage of undesirable fluids from the abandoned well 502 in the future. As with the other embodiments discussed herein, the hydrajetting tool 100 may be moved to one or more additional cement plugs that may be present within the abandoned wellbore 502 and seal any leak paths that may also exist therein.

In some embodiments, the portion of the cutting through the formation 504 and/or any disposed cement 518 at or near the cement plug 506 in the abandoned wellbore 502 may be cut not with the cement slurry 520, but with an abrasive jetting fluid. That is, an abrasive jetting fluid may be used to initially break through at least a portion of the formation 504 and may extend all the way through any disposed cement 518. Thereafter, the abrasive jetting fluid may be replaced with the cement slurry 520 for plugging and sealing the leak paths 508 in the cement plug 506. The abrasive jetting fluid may be used, for example, to save any costs associated with components of the cement slurry 520, to prevent or reduce the amount of cement slurry 520 that may cure in the intersecting wellbore 510, or simply to bleed the line of the cement slurry 520 (e.g., for washing purposes) without stopping an operation.

In some embodiments, the cement slurry of the present disclosure may comprise a base fluid and a cementitious material. Any aqueous base fluid suitable for use in forming a curable cerement slurry capable of use in a subterranean formation operation (e.g., for perforating, remedial work, and/or plug and abandonment operations) may be suitable for use in the embodiments described herein. Suitable base fluids may include, but are not limited to, freshwater; saltwater (e.g., water containing one or more salts dissolved therein); brine (e.g., saturated saltwater); seawater; and any combination thereof. Generally, the base fluid may be from any source provided, for example, that it does not contain an excess of compounds that may undesirably affect the pumpability through the hydrajetting tool or the curing capability of the cement slurry.

The cementitious material of the embodiments herein may be any cementitious material suitable for use in forming a curable cement slurry. In preferred embodiments, the cementitious material may be a hydraulic cement. Hydraulic cements harden by the process of hydration due to chemical reactions to produce insoluble hydrates (e.g., calcium hydroxide) that occur independent of the cement's water content (e.g., hydraulic cements can harden even under constantly damp conditions). Thus, hydraulic cements are preferred because they are capable of hardening regardless of the water content of a particular subterranean formation. Suitable hydraulic cements include, but are not limited to Portland cement; Portland cement blends (e.g., Portland blast-furnace slag cement and/or expansive cement); non-Portland hydraulic cement (e.g., super-sulfated cement, calcium aluminate cement, and/or high magnesium-content cement); and any combination thereof. Generally, the cementitious material may be present in the cement slurries described herein to achieve a cement slurry density in the range of from a lower limit of about 9.0 pounds per gallon ("ppg"), 10 ppg, 11 ppg, 12 ppg, 13 ppg, 14 ppg, 15 ppg, 16 ppg, and 17 ppg to an upper limit of about 25 ppg, 24 ppg, 23 ppg, 22 ppg, 21 ppg, 20 ppg, 19 ppg, 18 ppg, and 17 ppg.

In some embodiments, the cement slurry may additionally comprise a pozzolanic material. Pozzolanic materials may aid in increasing the density and strength of the cementitious material. As used herein, the term "pozzolanic material" refers to a siliceous material that, while not being cementitious, is capable of reacting with calcium hydroxide (which may be produced during hydration of the cementitious material). Because calcium hydroxide accounts for a sizable portion of most hydrated hydraulic cements and because calcium hydroxide does not contribute to the cement's properties, the combination of cementitious and pozzolanic materials may synergistically enhance the strength and quality of the cement. Any pozzolanic material that is reactive with the cementitious material may be used in the embodiments herein. Suitable pozzolanic materials may include, but are not limited to silica fume; metakaolin; fly ash; diatomaceous earth; calcined or uncalcined diatomite; calcined fullers earth; pozzolanic clays; calcined or uncalcined volcanic ash; bagasse ash; pumice; pumicite; rice hull ash; natural and synthetic zeolites; slag; vitreous calcium aluminosilicate; and any combinations thereof. In some embodiments, the pozzolanic material may be present in an amount in the range of a lower limit of about 5%, 7.5%, 10%, 12.5%, 15%, 17.5%, 20%, 22.5%, 25%, 27.5%, 30%, and 32.5% to an upper limit of about 60%, 57.5%, 55%, 52.5%, 50%, 47.5%, 45%, 42.5%, 40%, 37.5%, 35%, and 32.5% by weight of the dry cementitious material.

In some embodiments, the cement slurry may further comprise any cement additive for use in forming a curable cement slurry. Cement additives may be added in order to modify the characteristics of the cement slurry, for example. Such cement additives include, but are not limited to, a defoamer; a cement accelerator; a cement retarder; a fluid-loss additive; a cement dispersant; a cement extender; a weighting agent; a lost circulation additive; and any combination thereof. The cement additives of the embodiments herein may be in any form, including powder form or liquid form.

In some embodiments herein, an abrasive jetting fluid may be used to perform a portion of an operation (e.g., an intersecting plug and abandonment operation). The abrasive jetting fluid may comprise a base fluid and a cutting agent. The base fluid may be any base fluid suitable for use in a subterranean formation operation including those, for example, that are listed with reference to the base fluid for use in the cement slurries disclosed herein.

Suitable cutting agents may include, but are not limited to, any particulate capable of being ejected through the jetting nozzles of the hydrajetting tools disclosed herein and cutting formation, metal, cement, or other substances likely to be encountered during a subterranean operation, as described herein. Specific cutting agents may include small particulates having a coarse surface. Suitable particulates of this type may include, but are not limited to, bauxite, ceramic materials, glass materials, polymer materials, nutshell pieces, cured resinous particulates comprising nutshell pieces, seed shell pieces, cured resinous particulates comprising seed shell pieces, fruit pit pieces, cured resinous particulates comprising fruit pit pieces, wood, composite particulates, and combinations thereof. Suitable composite particulates may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. Generally, the cutting agent may range from less than about 4 mesh to about 100 mesh, or greater, on the U.S. Sieve Series. However, other cutting agent sizes may be desired and entirely suitable for practice of the embodiments described herein. Moreover, any particulate size distribution of the cutting agents may be used, including narrow and wide distributions. Generally, the cutting agent may be present in the abrasive jetting fluids described herein in an amount in the range of from a lower limit of about 0.5 pounds per gallon ("ppg"), 0.6 ppg, 0.7 ppg, 0.8 ppg, 0.9 ppg, 1 ppg, 1.1 ppg, 1.2 ppg, 1.3 ppg, 1.4 ppg, 1.5 ppg, 1.6 ppg, 1.7 ppg, 1.8 ppg, 1.9 ppg, 2 ppg, 2.1 ppg, 2.2 ppg, 2.3 ppg, 2.4 ppg, 2.5 ppg, 2.6 ppg, and 2.7 ppg to an upper limit of about 5 ppg, 4.9 ppg, 4.8 ppg, 4.7 ppg, 4.6 ppg, 4.5 ppg, 4.4 ppg, 4.3 ppg, 4.2 ppg, 4.1 ppg, 4 ppg, 3.9 ppg, 3.8 ppg, 3.7 ppg, 3.6 ppg, 3.5 ppg, 3.4 ppg, 3.3 ppg, 3.2 ppg, 3.1 ppg, 3.0 ppg, 2.9 ppg, 2.8 ppg, and 2.7 ppg. It is contemplated that cement particulates may also be used as the cutting agents described herein and may be included with any one or more of the additional cutting agents listed above. One of ordinary skill in the art, with the benefit of this disclosure will recognize the type and amount of cutting agent to use based on a particular operation (e.g., steel is a rather soft material and may not require particularly strong cutting agents).

Embodiments herein include:

A. A method comprising: providing a hydrajetting tool comprising a housing having a top end and a bottom end and having a plurality of jetting nozzles disposed thereon, the top end of the housing fluidly coupled to a tool string; positioning the hydrajetting tool adjacent to a substantially solid target; perforating or cutting the substantially solid target using a cement slurry injected through at least one of the plurality of jetting nozzles, thereby forming at least one perforation or cut.

Embodiment A may have one or more of the following elements in combination:

Element A1: Wherein the substantially solid target is selected from the group consisting of a metal, a cured cement, a formation rock, and any combination thereof.

Element A2: Further comprising expelling the cement slurry through at least one of the plurality of jetting nozzles at an adjustable rate and pressure.

Examples of non-limiting exemplary combinations may include: A with A2; A with A1 and A2.

B. A method comprising: providing a hydrajetting tool comprising a housing having a top end and a bottom end and having a plurality of jetting nozzles disposed thereon, the top end of the housing fluidly coupled to a tool string; introducing the hydrajetting tool into a subterranean formation, wherein a well casing is disposed in the subterranean formation forming an annulus between the well casing and the subterranean formation, the annulus having cured cement disposed therein; and perforating the well casing using a cement slurry through at least one of the plurality of jetting nozzles at a first treatment interval, thereby forming at least one perforation.

Embodiment B may have one or more of the following elements in combination:

Element B1: Wherein the cured cement has at least one leak path therein and further comprising: injecting the cement slurry through at least one of the plurality of jetting nozzles, through the at least one perforation, and into the leak path; and curing the cement slurry, thereby plugging the leak path.

Element B2: Wherein the hydrajetting tool further comprises a detachable lower sealing device located below the bottom end of the housing, and further comprising detaching the lower detachable sealing device from the hydrajetting tool and arranging it downhole of the first treatment interval prior to either the step of: perforating the well casing using the cement slurry, or the step of: injecting the cement slurry through the at least one of the plurality of jetting nozzles.

Element B3: Further comprising removing the lower sealing device after the cement slurry is cured.

Element B4: Wherein the hydrajetting tool further comprises a detachable upper sealing device located above the top end of the housing, and further comprising detaching the upper detachable sealing device and arranging it uphole of the first treatment interval prior to the step of: perforating the well casing using the cement slurry, or the step of: injecting the cement slurry through the at least one of the plurality of jetting nozzles, such that the hydrajetting tool interposes the upper sealing device and the lower sealing device.

Element B5: Further comprising removing the upper sealing device and the lower sealing device.

Element B6: Further comprising expelling the cement slurry through at least one of the plurality of jetting nozzles at an adjustable rate and pressure.

Element B7: Wherein the housing is rotatable about the tool string, and further comprising rotating the housing while injecting the cement slurry through at least one of the plurality of jetting nozzles.

Examples of non-limiting exemplary combinations may include: B with B2; B with B6 and B7; B with B4 and B5; B with B2 and B3; B with B2, B3, B4, and B5; B with B1 and B7.

C. A method comprising: providing a hydrajetting tool comprising a housing having a top end and a bottom end and having a plurality of jetting nozzles disposed thereon, the top end of the housing fluidly coupled to a tool string; introducing the hydrajetting tool into a subterranean formation, wherein a well casing is disposed in the subterranean formation forming an annulus between the well casing and the subterranean formation, the annulus having cured cement disposed therein, and wherein a sealing device is arranged in the subterranean formation, removing a circumferential portion of the well casing with a cement slurry through at least one of the plurality of jetting nozzles at a first treatment interval uphole of the sealing device; injecting the cement slurry in the removed circumferential portion of the well casing through at least one of the plurality of jetting nozzles and atop the sealing device; and curing the cement slurry, thereby forming a cement plug.

Embodiment C may have one or more of the following elements in combination:

Element C1: Wherein the cured cement has at least one leak path therein and further comprising: injecting the cement slurry through at least one of the plurality of jetting nozzles, through the at least one perforation, and into the leak path; and curing the cement slurry, thereby plugging the leak path.

Element C2: Further comprising expelling the cement slurry through at least one of the plurality of jetting nozzles at an adjustable rate and pressure.

Element C3: Further comprising repeating the steps of: removing the circumferential portion of the well casing with a cement slurry through at least one of the plurality of jetting nozzles; injecting the cement slurry in the removed circumferential portion of the well casing through at least one of the plurality of jetting nozzles and atop the sealing device; and curing the cement slurry, thereby forming a cement plug, at at least a second treatment interval.

Element C4: Wherein the housing is rotatable about the tool string, and further comprising rotating the housing while injecting the cement slurry in the removed circumferential portion of the well casing through at least one of the plurality of jetting nozzles.

Element C5: Wherein the hydrajetting tool further comprises a detachable sealing device located below the bottom end of the housing, and wherein arranging the sealing device in the subterranean formation further comprises detaching the detachable sealing device from the hydrajetting tool and arranging it downhole of the first treatment interval prior to the step of: removing the circumferential portion of the well casing with the cement slurry.

Element C6: Wherein the housing is rotatable about the tool string, and further comprising: positioning the hydrajetting tool uphole of the cement plug; rotating the housing while injecting the cement slurry at a rate and pressure sufficient to cut the casing string, wherein the cement slurry flows downhole and atop the cement plug, later curing thereon; and pulling at least a portion of the casing string from the subterranean formation.

Element C7: Wherein the step of removing the circumferential portion of the well casing with the cement slurry through at least one of the plurality of jetting nozzles, further comprises removing at least a portion of the cured cement in the annulus beneath the portion of the well casing with the cement slurry through at least one of the plurality of jetting nozzles, thereby exposing the subterranean formation.

Element C8: Wherein injecting the cement slurry to remove the circumferential portion of the well casing and at least a portion of the cured cement in the annulus washes the exposed subterranean formation of debris.

Element C9: Wherein the steps of removing the circumferential portion of the well casing with the cement slurry through at least one of the plurality of jetting nozzles and at least a portion of the cured cement in the annulus beneath the portion of the well casing, thereby exposing the subterranean formation; injecting the cement slurry in the removed circumferential portion; and curing the cement slurry, thereby forming a cement plug, is repeated at at least a second treatment interval.

Examples of non-limiting exemplary combinations may include: C with C1; C with C2; C with C6, C7, C8, and C9; C with C6; C with C3 and C4.

D. A method comprising: providing a hydrajetting tool comprising a housing having a top end and a bottom end and having a plurality of jetting nozzles disposed thereon, the top end of the housing fluidly coupled to a tool string; introducing the hydrajetting tool into an intersecting wellbore positioned substantially parallel to an abandoned wellbore, the abandoned wellbore having at least one cement plug having leak paths therein; positioning the hydrajetting tool adjacent to the cement plug; injecting a cement slurry through at least one of the plurality of jetting nozzles, through subterranean formation rock disposed between the intersecting wellbore and the abandoned wellbore, through the abandoned wellbore, and into the cement plug having leak paths therein; and curing the cement slurry, thereby plugging the leak paths.

Embodiments D may have one or more of the following elements in combination:

Element D1: Further comprising expelling the cement slurry through at least one of the plurality of jetting nozzles at an adjustable rate and pressure.

Element D2: Wherein the housing is rotatable about the tool string, and further comprising rotating the housing while injecting the cement slurry through at least one of the plurality of jetting nozzles.

Element D3: Further comprising forming the intersecting wellbore using the hydrajetting tool, wherein an abrasive jetting fluid is pumped through at least one of the plurality of jetting nozzles on the housing to form the intersecting well before the step of: positioning the housing of the hydrajetting tool adjacent to the cement plug.

Element D4: wherein prior to the step of: injecting a cement slurry through at least one of the plurality of jetting nozzles, through subterranean formation rock disposed between the intersecting wellbore and the abandoned wellbore, through the abandoned wellbore, and into the cement plug having leak paths therein, an abrasive jetting fluid is introduced through at least one of the plurality of jetting nozzles on the housing of the hydrajetting tool and at least partially through at least one of the subterranean formation rock disposed between the intersecting wellbore and the abandoned wellbore, the abandoned wellbore, and the cement plug having leak paths therein.

Examples of non-limiting exemplary combinations may include: D with D1 and D4; D with D2 and D4; D with D3 and D4; D with D1 and D2.

Therefore, the embodiments disclosed herein are well adapted to attain the ends and advantages mentioned as well as those that are inherent therein. The particular embodiments disclosed above are illustrative only, as they may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

providing a hydrajetting tool comprising a housing having a top end and a bottom end and having a plurality of jetting nozzles disposed thereon, the top end of the housing fluidly coupled to a tool string;

positioning the hydrajetting tool adjacent to a substantially solid target;

screening cement particulates from a cement slurry supplied to the hydrajetting tool; and perforating the substantially solid target using the cement slurry injected through at least one of the plurality of jetting nozzles, wherein the cement slurry erodes away the substantially solid target at a point of impact to form a hole through the substantially solid target.

2. The method of claim 1, wherein the substantially solid target is selected from the group consisting of a metal, a cured cement, a formation rock, and any combination thereof.

3. A method comprising:

introducing a hydrajetting tool into a subterranean formation, wherein the hydrajetting tool comprises a housing having a top end and a bottom end and having a plurality of jetting nozzles disposed thereon, the top end of the housing fluidly coupled to a tool string, wherein a well casing is disposed in the subterranean formation forming an annulus between the well casing and the subterranean formation, the annulus having cured cement disposed therein;

screening cement particulates from a cement slurry supplied to the hydrajetting tool; and perforating the well casing using the cement slurry through at least one of the plurality of jetting nozzles at a first treatment interval, wherein the cement slurry erodes away the well casing at a point of impact to form a hole through the well casing.

4. The method of claim 3, wherein the cured cement has at least one leak path therein and further comprising:

injecting the cement slurry through at least one of the plurality of jetting nozzles, through the at least one perforation, and into the leak path; and curing the cement slurry, thereby plugging the leak path.

5. The method of claim 4, wherein the hydrajetting tool further comprises a detachable lower sealing device located below the bottom end of the housing, and further comprising detaching the lower detachable sealing device from the hydrajetting tool and arranging it downhole of the first treatment interval prior to either:

perforating the well casing using the cement slurry, or injecting the cement slurry through the at least one of the plurality of jetting nozzles.

6. The method of claim 5, further comprising removing the lower sealing device after the cement slurry is cured.

7. The method of claim 5, wherein the hydrajetting tool further comprises a detachable upper sealing device located above the top end of the housing, and further comprising detaching the upper detachable sealing device and arranging it uphole of the first treatment interval prior to:

perforating the well casing using the cement slurry, or injecting the cement slurry through the at least one of the plurality of jetting nozzles, such that the hydrajetting tool interposes the upper sealing device and the lower sealing device.

8. The method of claim 7, further comprising removing the upper sealing device and the lower sealing device.

9. The method of claim 3, further comprising expelling the cement slurry through at least one of the plurality of jetting nozzles at an adjustable rate and pressure.

10. The method of claim 3, wherein the housing is rotatable about the tool string, and further comprising rotating the housing while injecting the cement slurry through at least one of the plurality of jetting nozzles.

11. A method comprising:

introducing a hydrajetting tool into a subterranean formation, wherein the hydrajetting tool comprises a housing having a top end and a bottom end and having a plurality of jetting nozzles disposed thereon, the top end of the housing fluidly coupled to a tool string, wherein a well casing is disposed in the subterranean formation forming an annulus between the well casing and the subterranean formation, the annulus having cured cement disposed therein, and wherein a sealing device is arranged in the subterranean formation, screening cement particulates from a cement slurry supplied to the hydrajetting tool, removing a circumferential portion of the well casing with the cement slurry through at least one of the plurality of jetting nozzles at a first treatment interval uphole of the sealing device, wherein the cement slurry erodes away the well casing at a point of impact;

without substantially moving the hydrajetting tool, injecting the cement slurry in the removed circumferential portion of the well casing through the at least one of the plurality of jetting nozzles and atop the sealing device; and curing the cement slurry, thereby forming a cement plug.

12. The method of claim 11, further comprising repeating for at least a second treatment interval removing the circumferential portion of the well casing with the cement slurry, injecting the cement slurry in the removed circumferential portion of the well casing, and curing the cement slurry.

13. The method of claim 11, wherein the housing is rotatable about the tool string, and further comprising rotating the housing while injecting the cement slurry in the removed circumferential portion of the well casing through at least one of the plurality of jetting nozzles.

14. The method of claim 11, wherein the hydrajetting tool further comprises a detachable sealing device located below the bottom end of the housing, and wherein arranging the sealing device in the subterranean formation further comprises detaching the detachable sealing device from the hydrajetting tool and arranging it downhole of the first treatment interval prior to removing the circumferential portion of the well casing with the cement slurry.

15. The method of claim 11, wherein the housing is rotatable about the tool string, and further comprising:

positioning the hydrajetting tool uphole of the cement plug;

rotating the housing while injecting the cement slurry at a rate and pressure sufficient to cut the casing string, wherein the cement slurry flows downhole and atop the cement plug, later curing thereon; and pulling at least a portion of the casing string from the subterranean formation.

16. The method of claim 11, wherein removing the circumferential portion of the well casing with the cement slurry through at least one of the plurality of jetting nozzles, further comprises removing at least a portion of the cured cement in the annulus beneath the portion of the well casing with the cement slurry through at least one of the plurality of jetting nozzles, thereby exposing the subterranean formation.

17. The method of claim 16, wherein injecting the cement slurry to remove the circumferential portion of the well casing and at least a portion of the cured cement in the annulus washes the exposed subterranean formation of debris.

18. The method of claim 16, wherein removing the circumferential portion of the well casing with the cement slurry, injecting the cement slurry in the removed circumferential portion, and curing the cement slurry, thereby forming a cement plug, is repeated at least fora second treatment interval.

19. The method of claim 16, wherein the housing is rotatable about the tool string, and further comprising:

positioning the hydrajetting tool uphole of the cement plug;

rotating the housing while injecting the cement slurry at a rate and pressure sufficient to cut the casing string, wherein the cement slurry flows downhole and atop the cement plug, later curing thereon; and pulling at least a portion of the casing string from the subterranean formation.

20. A method comprising:

providing a hydrajetting tool comprising a housing having a top end and a bottom end and having a plurality of jetting nozzles disposed thereon, the top end of the housing fluidly coupled to a tool string;

introducing the hydrajetting tool into an intersecting wellbore positioned at a distance of less than 1.2 meters from an abandoned wellbore, the abandoned wellbore having at least one cement plug having leak paths therein;

positioning the hydrajetting tool adjacent to the cement plug;

screening cement particulates from a cement slurry supplied to the hydrajetting tool; and injecting the cement slurry through at least one of the plurality of jetting nozzles, through subterranean formation rock disposed between the intersecting wellbore and the abandoned wellbore, through the abandoned wellbore, and into the cement plug having leak paths therein; and curing the cement slurry, thereby plugging the leak paths.

21. The method of claim 20, further comprising forming the intersecting wellbore using the hydrajetting tool, wherein an abrasive jetting fluid is pumped through at least one of the plurality of jetting nozzles on the housing to form the intersecting well before positioning the housing of the hydrajetting tool adjacent to the cement plug.

22. The method of claim 20, wherein prior to injecting a cement slurry through at least one of the plurality of jetting nozzles, through subterranean formation rock disposed between the intersecting wellbore and the abandoned wellbore, through the abandoned wellbore, and into the cement plug having leak paths therein, an abrasive jetting fluid is introduced through at least one of the plurality of jetting nozzles on the housing of the hydrajetting tool and at least partially through at least one of the subterranean formation rock disposed between the intersecting wellbore and the abandoned wellbore, the abandoned wellbore, and the cement plug having leak paths therein.

* * * * *